United States Patent [19]

Frank

[11] Patent Number: 4,691,880

[45] Date of Patent: Sep. 8, 1987

[54] TORSION SPRING POWERED MISSILE WING DEPLOYMENT SYSTEM

[75] Inventor: Arthur M. Frank, Plainview, N.Y.

[73] Assignee: Grumman Aerospace Corporation, Bethpage, N.Y.

[21] Appl. No.: 798,207

[22] Filed: Nov. 14, 1985

[51] Int. Cl.[4] ..... B64C 3/38; B64C 3/56

[52] U.S. Cl. ..... 244/49; 244/3.24; 244/3.27

[58] Field of Search ..... 244/41, 46, 3.24–3.3; 16/282, 309, 366, 294, 295, 273, 285, 289, 293; 267/154

[56] References Cited

U.S. PATENT DOCUMENTS

| | | | |
|---|---|---|---|
| 2,719,682 | 10/1955 | Handel | 244/49 |
| 2,867,841 | 1/1959 | Baldauf | 267/154 |
| 2,876,677 | 3/1959 | Clark et al. | 89/1.5 |
| 2,925,233 | 2/1960 | Dunn et al. | 244/49 |
| 2,925,966 | 2/1960 | Kongelbeck | 244/14 |
| 2,977,880 | 4/1961 | Kershner | 102/50 |
| 3,058,422 | 10/1962 | Olsson | 102/50 |
| 3,063,375 | 11/1962 | Hawley et al. | 102/50 |
| 3,065,938 | 11/1962 | Calkins | 244/46 |
| 3,377,882 | 4/1968 | Schrempp | 16/308 |
| 3,588,004 | 6/1971 | Suter | 244/3.29 |
| 3,724,373 | 4/1973 | Rivens | 102/4 |
| 4,165,847 | 8/1979 | Detalle | 244/3.29 |
| 4,410,151 | 10/1983 | Hoppner et al. | 244/63 |
| 4,416,151 | 10/1983 | Hoppner et al. | 244/63 |
| 4,523,728 | 6/1985 | Frazer | 244/3.29 |

FOREIGN PATENT DOCUMENTS

| | | | |
|---|---|---|---|
| 1950638 | 4/1971 | Fed. Rep. of Germany | 244/3.29 |
| 2649643 | 6/1978 | Fed. Rep. of Germany | 244/3.29 |
| 2153982 | 8/1985 | United Kingdom | 244/3.29 |

*Primary Examiner*—Joseph F. Peters, Jr.
*Assistant Examiner*—L. M. Fiorito
*Attorney, Agent, or Firm*—Pollock, VandeSande & Priddy

[57] ABSTRACT

A foldable missile wing is deployed by means of an overcenter linkage powered by a torsion spring assembly capable of exerting a generally linear bias on the linkage over its full range of motion. A separate lock linkage maintains the foldable wing in a deployed position until release actuation of the lock linkage occurs thereby enabling wing deployment.

3 Claims, 7 Drawing Figures

TORSION SPRING POWERED MISSILE WING DEPLOYMENT SYSTEM

FIELD OF THE INVENTION

The present invention relates to wing structures for guided missiles and more particularly to a folding wing configuration.

BACKGROUND OF THE INVENTION

In many present day military applications of guided missiles, the space requirements for a missile, due to wingspan, become an imposing factor. For example, the Penguin missile is a surface-to-surface weapon currently in the possession of a number of national navies. The missile is stored and launched from a canister approximately 43 inches×43 inches due to the relatively large wingspan of 1.49 meters. As will be appreciated, when storing a number of these missiles in canisters, the pressure of storage space becomes a primary concern. This is particularly the case when missiles of this sort are adapted for use by aircraft such as helicopters. If a relatively large missile with the corresponding necessarily large wingspan is to be employed, it has been recognized that a folding wing configuration must be designed to provide clearance with the ground plane and to provide a reasonable envelope when carried on an aircraft such as a helicopter.

If the folding wing configuration is to be employed, the fold mechanism must be enclosed within the wing contour and the wing deployment mechanism must be relatively lightweight and secure so that the wings will remain in a deployed position when a missile with the folding wing contour encounters air resistance and vibration after deployment.

The present assignee's copending patent application to Rosenberger, et al., entitled PENGUIN MISSILE FOLDING WING CONFIGURATION, filed Aug. 2, 1985, Ser. No. 764,457, 1985, offers an improved foldable wing configuration which employs a non-reversible mechanism dependent upon overcenter action. To operate the mechanism a pyrotechnic actuator is fired which displaces the overcenter mechanism to which the wing structure is attached. The use of such an actuator ensures a rapid certain deployment of the foldable wings to a non-reversible position.

Although assignee's copending application will operate generally satisfactorily, the use of a pyrotechnic device for actuating wing deployment suffers disadvantages, namely, safety, stowage, and an impulse actuation load on the overcenter deployment linkage which may adversely affect the performance characteristics of the deployment mechanism. Accordingly, it would be desirable to implement an actuating mechanism which exhibits a more linear actuating load on the deployment mechanism. A further problem with the utilization of pyrotechnic actuating devices is their performance variation with temperature, which poses a design concern.

BRIEF DESCRIPTION OF THE PRESENT INVENTION

The present invention utilizes a novel configuration of torsion springs in lieu of a pyrotechnic actuating device for deploying folded missile wings. The present invention allows for a straightforward design of an actuating mechanism which has predictable conservative performance.

The utilization of the present spring-powered system presents only minor performance variations with temperature, thereby alleviating this as a significant design concern. As a result, the spring-powered system exhibits a relative insensitivity to adverse environments, which is an important factor in strategic applications.

The torsion spring system of the present invention is actually a combination of torsion springs incorporating the concept of lost motion. As a result, the spring system can be tailored to closely match the relatively linear required hinge moments for smooth and reliable operation.

By folding the hinged wings into a storage condition, the springs become loaded; and an incorporated lock latch mechanism keeps the linkage loaded thereby eliminating any possibility of flutter when stationed in a ready position. Upon deployment, an overcenter linkage keeps the linkage loaded in the deployed condition thus eliminating any possibility of flutter during flight. The spring system energy output is consistent over the operative temperature range and does not exhibit variable energy output as a function of temperature as in the case of a pyrotechnic system.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
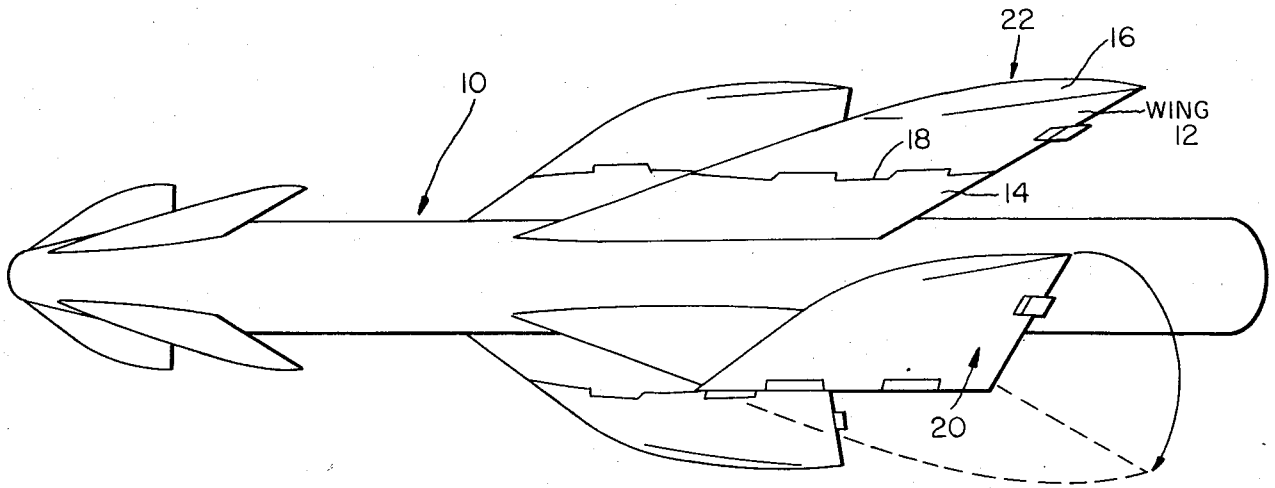
FIG. 1 is a perspective view of the exterior appearance of a missile having hinged wings and showing one of said wings in a folded, stored position.

FIG. 1 illustrates the external appearance of a missile equipped with foldable wings. The missile is generally indicated by reference numeral 10; and each wing, for example wing 12, includes an inboard wing section 14 connected by a hinge 18 to outboard section 16, which is deployed from a normally stored folded position, as shown by reference numeral 20, to an operational extended position, as indicated by reference numeral 22.

Figure 2:
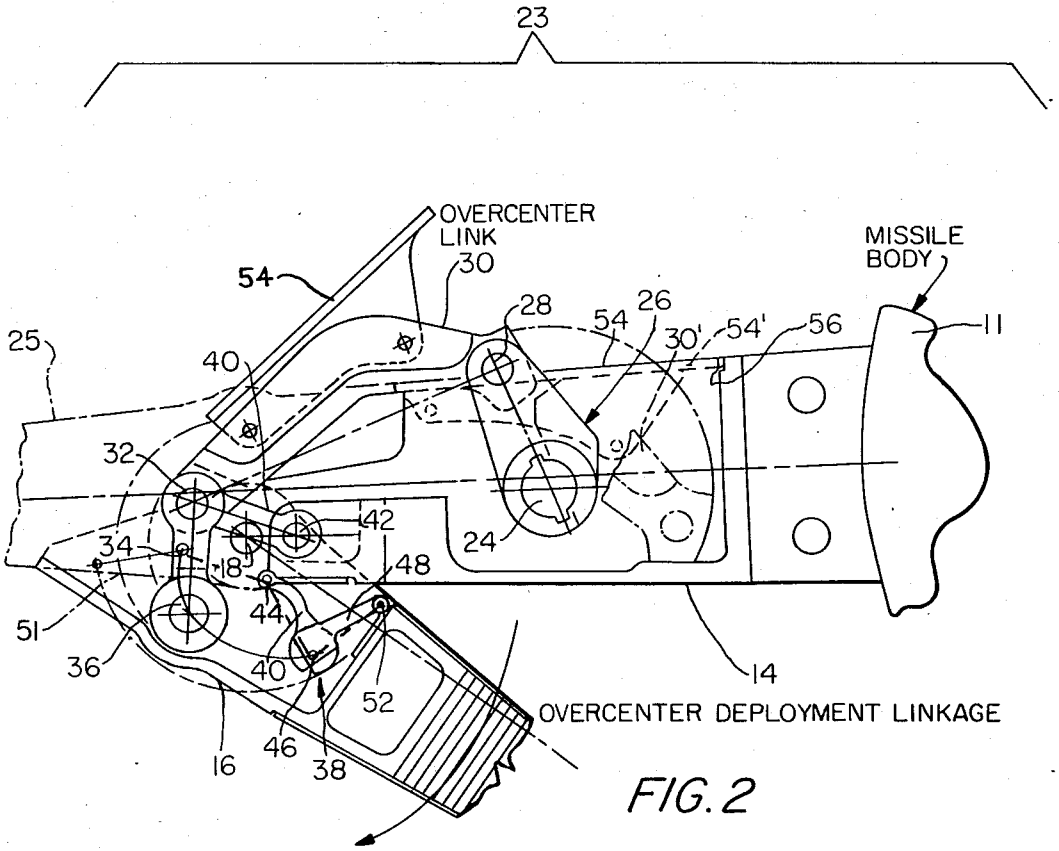
FIG. 2 is a sectional view of an overcenter deployment linkage as employed in the present invention.

An overcenter wing deployment linkage is shown in FIG. 2. The inboard section 14 is indicated as being a casting connected to the outboard foldable wing section 16 by the linkage. When completely deployed the foldable wing section 16 rotates clockwise, as indicated in FIG. 2, until it becomes coextensive with the inboard section 14, as indicated by the dotted lines 25.

The initiating member for the overcenter linkage is keyed shaft 24, which is connected to a first end of an overcenter crank 26. The opposite side of the crank is connected to pin 28, which mounts an overcenter link 30 in pivotal fashion. The opposite end of the overcenter link 30 is pivotally connected at pin 32 to an actuating link 34, which is pivotally connected at pin 36 to the outboard wing casting 16. Pin 32 is also connected to a first end of control link 40, while an opposite end is connected via pin 42 to an internal point on the casting of the inboard wing section 14. Skin closure 38 covers the underside of a deployed foldable wing in the vicinity of reference numeral 51, which would otherwise be an opening in the underside of the foldable wing section through which actuating link 34 normally extends, while the foldable wing section is in the stored condition. The closure includes a first link 40 which has its outward end pivotally connected at 44 to casting 14. A second link 48 is pivotally connected at pin 46 to the link 40, the outward end of link 48 being pivotally connected to outboard wing section 16 at pin 52. When the wing section 16 is rotated in a clockwise position for deployment, the links 40 and 48 will become positioned in a skin closure configuration.

The overcenter link 30 includes an extended surface 54, integrally connected therewith, which serves as an inboard casting skin closure of opening 56. When the foldable wing section 16 is rotated about hinge 18 to a deployed position, the overcenter link 30 rotates clockwise in the same direction as the foldable wing section 16 until the overcenter link 30 assumes the fully deployed position at 30', with the extended surface in a closing position indicated by reference numeral 54'.

Figure 3:
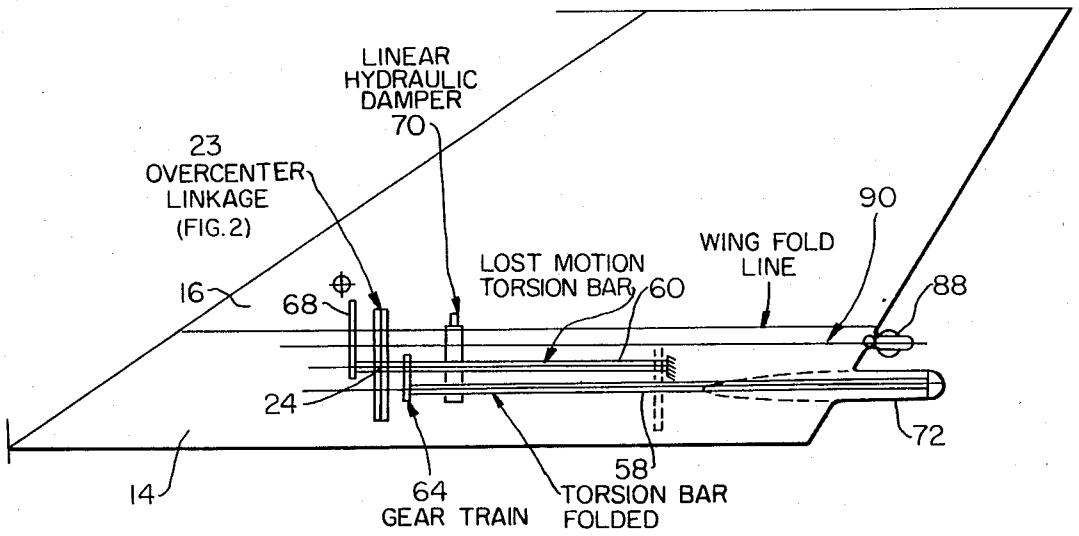
FIG. 3 is a diagrammatic elevational view of the spring-power mechanism as employed in the present invention.

FIG. 3 is a simplified illustration of a deployed wing wherein the inboard or stationary wing section 14 becomes coextensive with the extended or deployed wing section 16.

Figure 7:
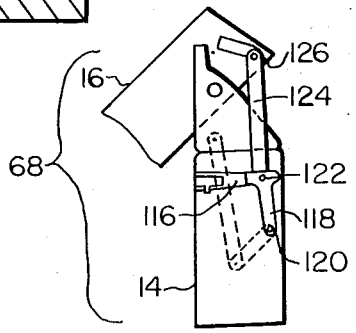
FIG. 7 is a sectional view taken along section line 7—7 of FIG. 6.

Reference numeral 58 indicates a folded torsion bar structure which is mechanically linked with a lost motion torsion bar 60 to provide a spring-power mechanism for deploying the foldable wing section 16. The structure of the torsion bar 58 is dealt with in detail, in connection with the discussion of FIG. 4. The torsion bars 58 and 60 lie longitudinally along inboard wing section 14. Both torsion bars are connected via a gear train 64 to the splined shaft 24 which drives the overcenter deployment linkage, as previously explained in connection with FIG. 2. The overcenter linkage is generally indicated in FIGS. 2 and 3 by reference numeral 23. A linkage 68, discussed in greater detail in connection with FIG. 7, is located between the inboard wing section 14 and the outboard wing section 16 to lock the sections before deployment. In order to ensure smooth deployment of the outboard wing section 16, a linear hydraulic damper 70 is located in the inboard wing section 14 while extending outwardly to make contact with the outboard wing section 16. A bulbous extension 72 of the inboard wing section 14 exists aft to allow extended length, and consequently driving force, to the dual torsion bar structure 58.

Figure 4:
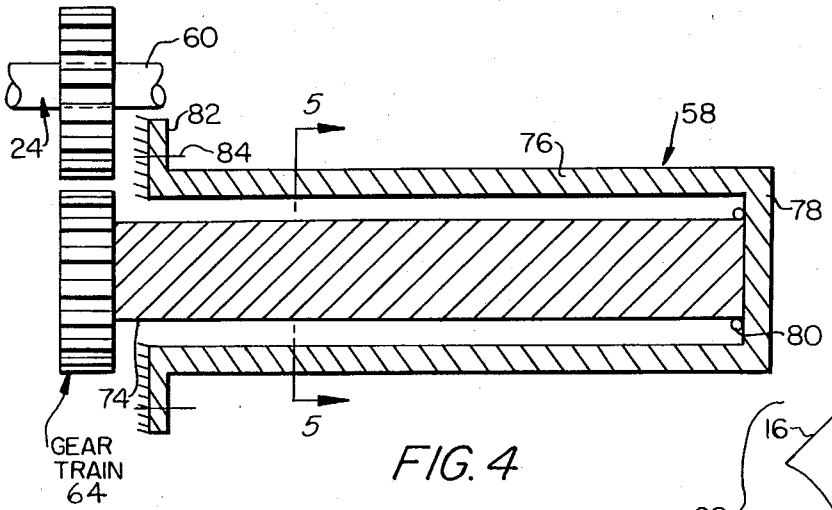
FIG. 4 is a sectional view of a folded torsion spring partially powering the wing deployment mechanism of the invention.

FIG. 4 illustrates in detail a novel torsion bar structure generally indicated by reference numeral 58, similarly numbered and generally indicated in FIG. 3. The overcenter linkage keyed shaft 24 is connected to solid cylindrical torsion bar 74 having a hollowed cylindrical torsion bar 76 positioned in concentrically encircling relation. A round plate 78 is suitably welded, at 80, to the right end of torsion bar 74 so that there is linked torsional displacement of both torsion bars 74 and 76. In lieu of the weld 80, pins or other suitable connectors may be employed. The left end of hollowed cylindrical torsion bar 76 is fastened, by suitable fasteners 84, to the inboard wing section casting at 82.

In operation of the torsion bars 58 and 60 (FIG. 3), the foldable wing section 16 is folded to a stored position. The overcenter linkage 23 being connected between the inner and outer wing sections is displaced, and keyed shaft 24 is rotated thereby causing linked rotation through gear train 64. The folded torsion bar structure 58 is connected to shaft 24 via gear train 64, and the lost motion torsion bar 60 is directly connected to the shaft 24. Thus, the torsion bars are similarly rotated to a loaded condition. By constructing torsion bar 58 with dual torsion bars 74, 76 (FIG. 4) in concentric or "folded" relation, the same spring action is available as if a single torsion bar were used having twice the length, which would be impractical from a space consideration. The lost motion torsion bar 60 provides substantial bias during initial deployment of the foldable wing section so that the folded torsion bar structure 58 can subsequently operate the overcenter linkage with linear bias in the lost motion region of the linkage.

Figure 5:
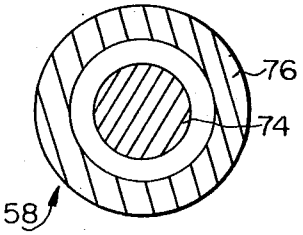
FIG. 5 is a sectional view taken along section line 5—5 of FIG. 4.

FIG. 7 illustrates a lock linkage 68 (also shown in FIG. 3) for maintaining foldable wing section 16 in a normally folded position. A roller link 116 is located in the fixed wing section 14 and contacts the pivot 122 between lock links 118 and 124. Link 118 is pivotally connected to the casting of the fixed wing section 14 at 120 while link 124 is pivotally connected to the foldable wing section 16 at 126. Upon actuation of the internal release system illustrated in FIG. 6 and to be presently discussed, the roller link 116 is displaced from contact with the lock links 118, 124 at the pivot 122. As a result, the links will be free to rotate to the position shown in dotted lines as the torsion bar spring-powered system, just discussed in connection with FIGS. 4 and 5, drives the foldable wing section 16 into a deployed position.

The location of the internal release system for releasing the links 118 and 124 is generally indicated in FIG. 3 by actuating means 90 extending longitudinally along the length of the fixed wing section 14 and having a lanyard attachment point at the illustrated far right end of the actuating means 90, as indicated at reference numeral 88. With a lanyard (not shown) attached and pulled, the actuating means 90 is displaced to the right thereby causing rotation of the roller link 116 from locking engagement with links 118 and 124.

Figure 6:
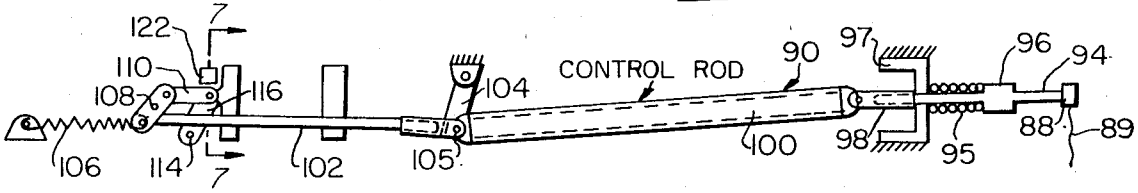
FIG. 6 is a simplified elevational view of a system for releasing the deployment system of the invention.

To review the internal release system more specifically, reference is made to FIG. 6 which indicates the actuating means 90 in greater detail. A plunger 94 has its rightmost end resting against a mechanical stop 88 that may be displaced by pulling lanyard 89 or another appropriate actuating device. A spring 95 is positioned between a boss 96 integrally formed on plunger 94 and a fixed structural member 97. When the lanyard 89 is pulled, spring 95 exerts a force against boss 96 which in turn displaces plunger 94 to the right. The plunger 94 is connected to a rod 98, the latter being pivotally connected to a main control rod 100. The left-illustrated end of the control rod 100 is characterized by a pivot 105 supported by link 104, which is fixed to the casting of the fixed wing section 14 and is also connected to the right-illustrated end of rod 102. The left-illustrated end of rod 102 is connected to fixed spring 106 which normally urges rods 102, 100, 98 and plunger 94 to the left. When the lanyard is displaced, these rods and plunger move to the right thereby causing counterclockwise rotation of the linkage comprising links 108, 110 and 116. Link 108 is connected to spring 106, along with rod 102, while a lower illustrated end of link 116 is pivotally connected at 114 to the inboard casting of wing sectionn 14. Movement of the links 108 and 110 causes translated motion of link 116 (FIG. 7) to initiate the unlocking of links 118 and 124 as previously explained. A ground lock pin (not shown) may be installed in plunger 94 to prevent inadvertent actuation of the internal release system. When the foldable wings are to be deployed, the pin may be removed.

The invention as described renders predictable conservative performance. By relying upon the described torsion spring mechanism, substantial independence from temperature variations may be realized and the entire mechanism is relatively insensitive to adverse environments.

The special advantages of the present invention, as will be appreciated from an understanding of the above-discussed structure, includes the elimination of pyrotechnic actuating devices and special handling. Further, the invention may be test cycled and reset without the need for refurbishment. Still further, no connections between a missile wing and body are necessary during wing assembly.

It should be understood that the invention is not limited to the exact details of construction shown and described herein for obvious modifications will occur to persons skilled in the art.

What is claimed is:

1. A foldable wing deployment system comprising:

a fixed wing section;

a foldable wing section hinged to the fixed wing section;

an overcenter linkage connecting the fixed and foldable wing sections for securely deploying the foldable wing section to a coextensive position with the fixed wing section;

a first torsion bar having a first end connected to a first gear;

a hollowed cylindrical torsion member mounted over the torsion bar, a first end of the member being fixed and a second end being connected to a corresponding second end of the torsion bar;

a second torsion bar located in parallel proximity to the cylindrical torsion member and connected to the overcenter linkage; and a second gear mounted on the second torsion bar and contacting the first gear for exerting supplementary bias on the overcenter linkage during initial operation thereof for ensuring a substantially linear actuating drive on the linkage, necessary for smooth and reliable wing deployment.

2. The structure set forth in claim 1 together with lock linkage means connected between the fixed and foldable wing sections for maintaining the latter section in a folded condition until the lock linkage means is operated to allow deployment of the foldable wing section.

3. The structure set forth in claim 2 wherein the lock linkage means comprises:

first and second links joined at first ends thereof to a common pivot;

means connecting opposite ends of the first and second links to the fixed and foldable wing sections, respectively;

roller means restraining the pivot to retain the lock linkage means in a locked condition; and means for displacing the roller means from engagement to release the foldable wing section for deployment.

* * * * *

UNITED STATES PATENT AND TRADEMARK OFFICE

CERTIFICATE OF CORRECTION

PATENT NO. : 4,691,880

DATED : September 8, 1987

INVENTOR(S) : Arthur M. Frank

It is certified that error appears in the above-identified patent and that said Letters Patent is hereby corrected as shown below:

Column 1, line 39, after "764,457" delete "1985".

Column 5, line 2, change "sectionn" to --section--.

Signed and Sealed this

Nineteenth Day of April, 1988

*Attest:*

*Attesting Officer*

DONALD J. QUIGG

*Commissioner of Patents and Trademarks*